US007541979B2

(12) United States Patent
Takei et al.

(10) Patent No.: US 7,541,979 B2
(45) Date of Patent: Jun. 2, 2009

(54) SMALL SIZE THIN TYPE ANTENNA, MULTILAYERED SUBSTRATE, HIGH FREQUENCY MODULE, AND RADIO TERMINAL MOUNTING THEM

(75) Inventors: Ken Takei, Hitachi (JP); Tomoyuki Ogawa, Hitachi (JP); Morihiko Ikegaya, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 180 days.

(21) Appl. No.: 11/252,889

(22) Filed: Oct. 19, 2005

(65) Prior Publication Data

US 2006/0097932 A1 May 11, 2006

(30) Foreign Application Priority Data

Oct. 20, 2004 (JP) ..... 2004-305873

(51) Int. Cl.
*H01Q 1/38* (2006.01)

(52) U.S. Cl. ..... 343/700 MS; 343/702

(58) Field of Classification Search ..... 343/700 MS, 343/702, 846, 848
See application file for complete search history.

(56) References Cited

U.S. PATENT DOCUMENTS

| | | | | |
|---|---|---|---|---|
| 5,581,262 | A | 12/1996 | Kawahata et al. | |
| 6,535,170 | B2 * | 3/2003 | Sawamura et al. | 343/702 |
| 6,774,850 | B2 * | 8/2004 | Chen | 343/700 MS |
| 6,812,892 | B2 * | 11/2004 | Tai et al. | 343/700 MS |
| 6,861,986 | B2 * | 3/2005 | Fang et al. | 343/700 MS |
| 6,930,640 | B2 * | 8/2005 | Chung et al. | 343/700 MS |
| 6,963,310 | B2 * | 11/2005 | Horita et al. | 343/702 |
| 7,253,772 | B2 * | 8/2007 | Chi et al. | 343/700 MS |
| 2002/0093456 | A1 | 7/2002 | Sawamura et al. | |
| 2002/0140610 | A1 | 10/2002 | Onaka et al. | |
| 2003/0080904 | A1 * | 5/2003 | Chen | 343/700 MS |

FOREIGN PATENT DOCUMENTS

| | | |
|---|---|---|
| JP | 01-158805 | 6/1989 |
| JP | 03-192805 | 8/1991 |
| JP | 06-069717 | 3/1994 |
| JP | 62-39317 | 3/1994 |
| JP | 70221537 | 8/1995 |
| JP | 07-235825 | 9/1995 |
| JP | 2002-158529 | 5/2002 |
| JP | 2002-185238 | 6/2002 |
| JP | 2002-299933 | 10/2002 |
| JP | 2004-221661 | 8/2004 |
| JP | 2004-266681 | 9/2004 |
| JP | 2004-274223 | 9/2004 |

OTHER PUBLICATIONS

Japanese Office Action dated Nov. 4, 2008 with English Translation.

* cited by examiner

*Primary Examiner*—Tan Ho
(74) *Attorney, Agent, or Firm*—McGinn IP Law Group, PLLC

(57) ABSTRACT

A small size thin type antenna using a thin type structure having a wavelength compaction effect without using a bulk conductive material and a high frequency module using the same are disclosed. The small size thin type antenna comprises an open stub 3 including at least one transmission line 13, 16, a connecting line 5 including at least one transmission line 15, and a short stub 4 including a transmission line 14. A characteristic impedance Zo of the open stub 3 is determined to be lower than a characteristic impedance Zb of the connecting line 5 and a characteristic impedance Zs of the short stub 4.

20 Claims, 13 Drawing Sheets

1 SIGNAL SOURCE
14
21
A'8
B8
B'8
31
32 THROUGH-HOLE
A8
20 GROUNDING CONDUCTIVE PLATE
30 DIELECTRIC PLATE

13 FIRST TRANSMISSION LINE
30
14 SECOND TRANSMISSION LINE
21 COULPLING CONDUCTOR
20

31 ISLAND SHAPE CONDUCTOR
32
30
20

1
SIGNAL
SOURCE
15
THIRD
TRANSMISSION
LINE
B9
B'9
31
32
A9
A'9
16
20
GROUNDING
CONDUCTIVE
PLATE
30
DIELECTRIC
PLATE

16
FOURTH
TRANSMISSION
LINE
30
20

31
ISLAND
SHAPE
CONDUCTOR
32
THROUGH-HOLE
30
20

15 THIRD TRANSMISSION LINE
1A FEEDING POINT
41 HIGH FREQUENCY INPUT LINE
A12
A'12
16 FOURTH TRANSMISSION LINE
40 HIGH FREQUENCY RECEIVING CIRCUIT
20 GROUNDING CONDUCTIVE PLATE
30 DIELECTRIC PLATE
44 OUTPUT LINE
43 CONTROL SIGNAL LINE
42 POWER SOURCE LINE 41
30
16
20

41
16
30
20
15 THIRD TRANSMISSION LINE
1A FEEDING POINT
41 HIGH FREQUENCY INPUT LINE
A13
A'13
16 FOURTH TRANSMISSION LINE
50 HIGH FREQUENCY TRANSMITTING AND RECEIVING CIRCUIT
20 GROUNDING CONDUCTIVE PLATE
42 POWER SOURCE LINE
30 DIELECTRIC PLATE
43 CONTROL SIGNAL LINE
44 OUTPUT LINE
55 INPUT LINE

15 THIRD TRANSMISSION LINE
1A FEEDING POINT
41 HIGH FREQUENCY INPUT LINE
A14
A'14
16 FOURTH TRANSMISSION LINE
50 FIRST HIGH FREQUENCY TRANSMITTING AND RECEIVING CIRCUIT
62 SECOND HIGH FREQUENCY TRANSMITTING AND RECEIVING CIRCUIT
61 SECOND THROUGH-HOLE
42 POWER SOURCE LINE
20 GROUNDING CONDUCTIVE PLATE
43 CONTROL SIGNAL LINE
30 FIRST DIELECTRIC PLATE
44 OUTPUT LINE
55 INPUT LINE 60
20
61

16
30
41
20
60

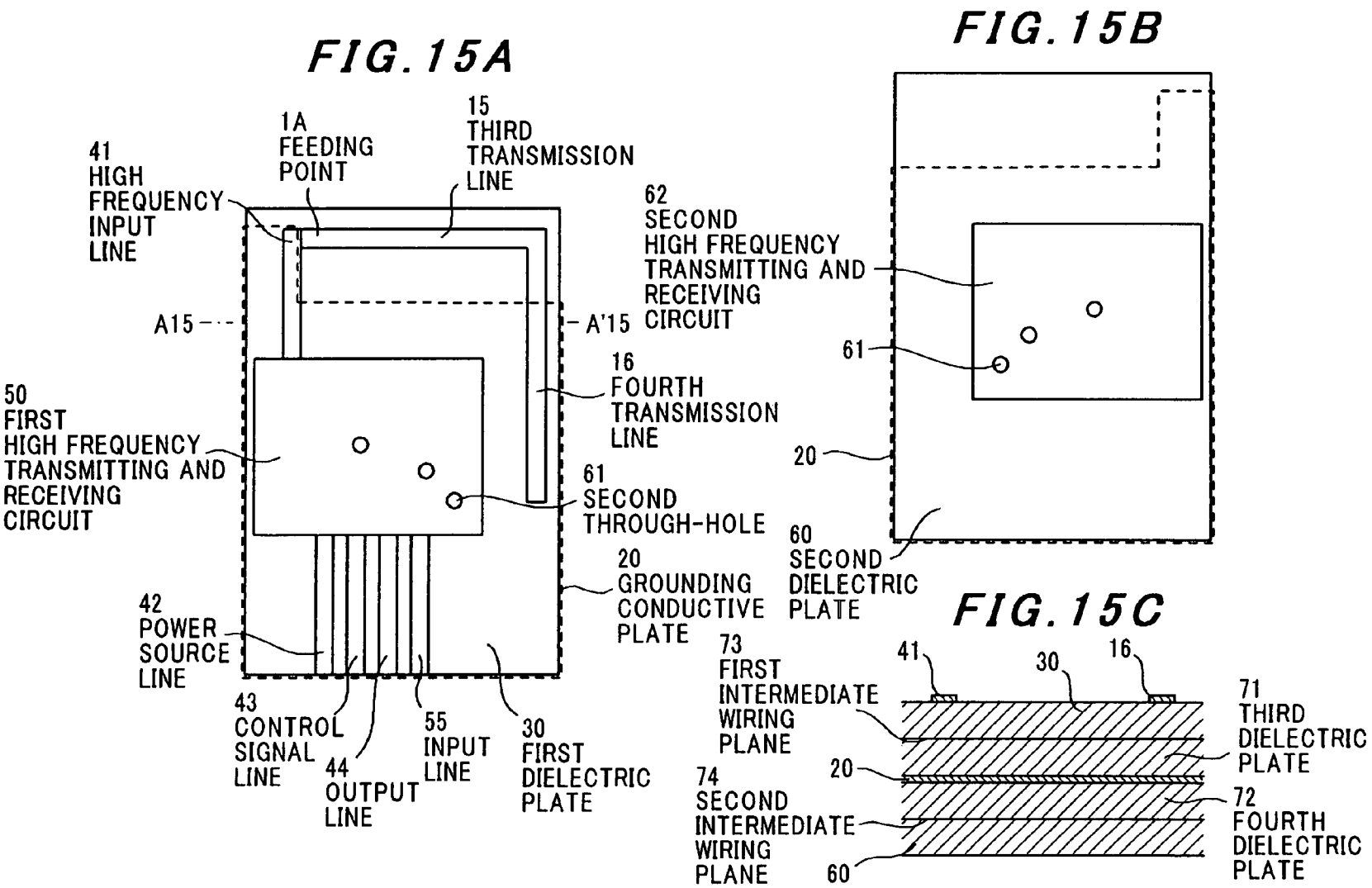
FIG. 15A
FIG. 15B
FIG. 15C
1A FEEDING POINT
15 THIRD TRANSMISSION LINE
41 HIGH FREQUENCY INPUT LINE
A15
A'15
50 FIRST HIGH FREQUENCY TRANSMITTING AND RECEIVING CIRCUIT
62 SECOND HIGH FREQUENCY TRANSMITTING AND RECEIVING CIRCUIT
16 FOURTH TRANSMISSION LINE
61 SECOND THROUGH-HOLE
20 GROUNDING CONDUCTIVE PLATE
42 POWER SOURCE LINE
43 CONTROL SIGNAL LINE
44 OUTPUT LINE
55 INPUT LINE
30 FIRST DIELECTRIC PLATE
20
60 SECOND DIELECTRIC PLATE
61
16
30
41
71 THIRD DIELECTRIC PLATE
72 FOURTH DIELECTRIC PLATE
73 FIRST INTERMEDIATE WIRING PLANE
74 SECOND INTERMEDIATE WIRING PLANE
20
60

SMALL SIZE THIN TYPE ANTENNA, MULTILAYERED SUBSTRATE, HIGH FREQUENCY MODULE, AND RADIO TERMINAL MOUNTING THEM

The present application is based on Japanese Patent Application No. 2004-305873 filed on Oct. 20, 2005, the entire contents of which are incorporated herein by reference.

BACKGROUND OF THE INVENTION

1. Field of the Invention

The present invention relates to a small size thin type antenna to be equipped with a radio terminal, a multilayered substrate, a high frequency module, and a radio terminal mounting them for providing a user with multimedia services ubiquitously, and more particularly, to a small size thin type antenna, a multilayered substrate, a high frequency module, and radio terminal mounting them, for realizing information transmission by the medium of electromagnetic wave having a wavelength greater than dimensions of the radio terminal.

2. Description of the Related Art

In recent years, various radio terminals have been developed and put into practical use to provide a user with various kinds of information transmission services ubiquitously. Since these services have been diversified year by year into various services, for instance, telephone, television, and local area network (LAN), the user should possess radio terminals corresponding to the respective services for enjoying all services.

So as to improve the convenience of the user enjoying such various services, the realization of a so-called "multimode terminal (multimedia terminal)", which can complete a plurality of the ubiquitous information transmission services by a single terminal, becomes a great social need.

Use of electromagnetic wave media provides the ubiquitous information transmission services for a normal radio communication. Therefore, it is necessary to employ one frequency for providing one kind of service to provide plural services to the user in a same coverage area.

Accordingly, for the multimedia terminal, a function for transmitting and receiving electromagnetic waves of the plural frequencies is required.

One of key devices for such a multimedia terminal is a multimode antenna having sensitivity for the electromagnetic waves of plural frequencies.

The multimode antenna is an antenna with a single configuration, which provides an excellent matching property between a characteristic impedance of a high frequency circuit in the radio terminal and a characteristic impedance of a free space for the electromagnetic waves of the plural frequencies.

A frequency band to be covered by the multimode antenna has been broadened in accordance with the various services required by the user, such that the frequency range is much lower than a frequency band (800 MHz to 2 GHz) used in the conventional wireless phone. Particularly, a need for realizing broadcasting services for the mobile radio terminal other than the telecommunication rises in recent years. Therefore, there is a requirement for the antenna, which has sensitivity for a frequency band lower than that for the wireless phone, for instance, a frequency band of 200 to 600 MHz.

A wavelength of such a low frequency wave is 0.6 to 1.8 m, which is remarkably greater than dimensions of the mobile radio terminal. Therefore, it becomes difficult to provide the mobile phone terminal with a ¼ to ½ wavelength of the radio wave, which corresponds to an effective electrical length of the antenna required for receiving this radio wave.

For overcoming the above described disadvantage, the prior art, for instance, Japanese Patent Laid-Open (Kokai) No. 1-158805 (JP-A-1-158805) proposes an aerial wire (antenna), in which a conductor emitting a radio wave is formed within a bulk dielectric material, and an electrical length of the antenna is made to be greater than a physical length of the radiating conductor by utilizing a wavelength compaction function of the dielectric material, thereby realizing equivalently an antenna with a greater electrical length in a mobile radio terminal with smaller physical dimensions.

However, since a three-dimensional dielectric bulk element is used in this prior art, it is necessary to provide a height greater than a predetermined height (0.5 to 0.8 mm) in a vertical direction viewed from a circuit board of the mobile radio terminal to be used. Accordingly, there is a disadvantage in that the antenna according to this prior art is not suitable for sliming the mobile radio terminal, so that it becomes a great obstacle for another need in the user's convenience, namely, the improvement in portability by sliming of the device.

In addition, since the bulk element is used for the antenna, when realizing a high frequency module including this antenna as an essential element, a flexibility of the high frequency module will be remarkably decreased. Accordingly, the high frequency of the module and the mounting configuration for the radio device are largely limited, so that it becomes a great obstacle for development of the device and decrease of fabrication steps due to the decrease in freedom of device design and fabrication method.

SUMMARY OF THE INVENTION

Accordingly, it is an object of the present invention to provide a small size thin type antenna, a multilayered substrate, a high frequency module, and radio terminal mounting them, for realizing a small size and inexpensive multimedia radio terminal, which provides a user with a radio communication services represented by a broadcasting service using a radio wave with a remarkably lower frequency compared with a frequency used for the wireless phone.

According to a first feature of the invention, a small size thin type antenna, an electrical structure of which is expressed by a topology, comprises:

an open stub and a connecting line or short stub;

wherein a characteristic impedance of the open stub is lower than a characteristic impedance of the connecting line or the short stub.

According to a second feature of the invention, in the small size thin type antenna of the first feature, the open stub comprises a microstrip line, and a strip conductor constituting the connecting line or short stub does not completely face to a grounding conductor planarly.

According to a third feature of the invention, in the small size thin type antenna of the second feature, the strip conductor constituting the connecting line or short stub comprises a coplanar line which is grounded to the grounding conductor at either one or both sides.

According to a fourth feature of the invention, in the small size thin type antenna of the first feature, the grounding conductor comprises a first grounding conductive plate, the open stub comprises a first strip conductor facing completely to the first grounding conductive plate planarly, and the connecting line or short stub comprises a second strip conductor which is positioned coplanar to the first grounding conductive plate.

According to a fifth feature of the invention, in the small size thin type antenna of the first feature, the grounding conductor comprises a first grounding conductive plate, the open stub comprises a first strip conductor facing completely to the first grounding conductive plate planarly, and the connecting line or short stub comprises a second strip conductor which is position coplanar to the first strip conductor and does not face to the first grounding conductive plate planarly.

According to a sixth feature of the invention, the small size thin type antenna of the fourth feature further comprises:

a second grounding conductive plate which surrounds the open stub coplanarly and is coupled electrically with the first grounding conductive plate.

According to a seventh feature of the invention, the small size thin type antenna of the fifth feature further comprises:

a second grounding conductive plate which surrounds the open stub coplanarly and is coupled electrically with the first grounding conductive plate.

According to an eighth feature of the invention, in the small size thin type antenna of the fourth feature, the first grounding conductive plate, the second grounding conductive plate, the first strip conductor constituting the open stub, and the second strip conductor constituting the connecting line or short stub are formed on respective surfaces of a dielectric layer.

According to a ninth feature of the invention, in the small size thin type antenna of the eighth feature, the first grounding conductive plate and the second grounding conductive plate are coupled electrically with each other via a through hole formed at the dielectric layer.

According to a tenth feature of the invention, in the small size thin type antenna of the eighth feature, the first grounding conductive plate and the second grounding conductive plate are coupled electrically with each other via a plated conductor formed at a peripheral part of the dielectric layer.

According to an eleventh feature of the invention, a multi-layered substrate for a small size thin type antenna, comprises:

a dielectric layer, and a first grounding conductive plate, a second grounding conductive plate, a first strip conductor constituting an open stub, and a second strip conductor constituting a connecting line or short stub, respectively, mounted on both surfaces of the dielectric layer.

According to a twelfth feature of the invention, a high frequency module, comprises:

a multi-layered substrate which comprises:

a dielectric layer, and a first grounding conductive plate, a second grounding conductive plate, a first strip conductor constituting an open stub, and a second strip conductor constituting a connecting line or short stub, respectively, mounted on both surfaces of the dielectric layer.

According to a thirteenth feature of the invention, a radio terminal, comprises:

a small size thin type antenna, an electrical structure of which is expressed by a topology, which comprises:

an open stub; and a connecting line or short stub;

wherein a characteristic impedance of the open stub is lower than a characteristic impedance of the connecting line or the short stub.

According to a fourteenth feature of the invention, a radio terminal, comprises:

a multi-layered substrate which comprises:

a dielectric layer, and a first grounding conductive plate, a second grounding conductive plate, a first strip conductor constituting an open stub, and a second strip conductor constituting a connecting line or short stub, respectively, mounted on both surfaces of the dielectric layer.

According to a fifteenth feature of the invention, a radio terminal, comprises:

a high frequency module which comprises a multi-layered substrate which comprises:

a dielectric layer, and a first grounding conductive plate, a second grounding conductive plate, a first strip conductor constituting an open stub, and a second strip conductor constituting a connecting line or short stub, respectively, mounted on both surfaces of the dielectric layer.

BRIEF DESCRIPTION OF THE DRAWINGS

Preferred embodiments present invention will be described in conjunction with appended drawings, wherein:

FIGS. 4A and 4B are diagrams showing a small size thin type antenna in a first preferred embodiment according to the invention, wherein FIG. 4A is a plan view, and FIG. 4B is a cross sectional view of FIG. 4A cut along A4-A4' line;

FIGS. 5A and 5B are diagrams showing a small size thin type antenna in a second preferred embodiment according to the invention, wherein FIG. 5A is a plan view, and FIG. 5B is a cross sectional view of FIG. 5A cut along A5-A5' line;

FIGS. 6A and 6B are diagrams showing a small size thin type antenna in a third preferred embodiment according to the invention, wherein FIG. 6A is a plan view, and FIG. 6B is a cross sectional view of FIG. 6A cut along A6-A6' line;

FIGS. 7A and 7B are diagrams showing a small size thin type antenna in a fourth preferred embodiment according to the invention, wherein FIG. 7A is a plan view, and FIG. 7B is a cross sectional view of FIG. 7A cut along A7-A7' line;

FIGS. 8A to 8C are diagrams showing a small size thin type antenna in a fifth preferred embodiment according to the present invention, wherein FIG. 8A is a plan view, FIG. 8B is a cross sectional view of FIG. 8A cut along A8-A'8 line, and FIG. 8C is a cross sectional view of FIG. 8A cut along B8-B'8 line;

FIGS. 9A to 9C are diagrams showing a small size thin type antenna in a sixth preferred embodiment according to the present invention, wherein FIG. 9A is a plan view, FIG. 9B is a cross sectional view of FIG. 9A cut along A9-A'9 line, and FIG. 9C is a cross sectional view of FIG. 9A cut along B9-B'9 line;

FIGS. 10A and 10B are diagrams showing a small size thin type antenna in a seventh preferred embodiment according to the present invention, wherein FIG. 10A is a plan view, and FIG. 10B is a cross sectional view of FIG. 10A cut along A10-A'10 line.

FIGS. 11A and 11B are diagrams showing a small size thin type antenna in an eighth preferred embodiment according to the present invention, wherein FIG. 11A is a plan view, and FIG. 11B is a cross sectional view of FIG. 11A cut along A11-A'11 line;

FIGS. 12A and 12B are diagrams showing a high frequency module in a ninth preferred embodiment according to the present invention, wherein FIG. 12A is a plan view, and FIG. 12B is a cross sectional view of FIG. 12A cut along A12-A'12 line;

FIGS. 13A and 13B are diagrams showing a high frequency module in a tenth preferred embodiment according to the present invention, wherein FIG. 13A is a plan view, and FIG. 13B is a cross sectional view of FIG. 13A cut along A13-A'13 line;

FIGS. 14A to 14C are diagrams showing a high frequency module in an eleventh preferred embodiment according to the present invention, wherein FIG. 14A is a plan view, FIG. 14B is a bottom view, and FIG. 14C is a cross sectional view of FIG. 14A cut along A14-A'14 line;

FIGS. 15A to 15C are diagrams showing a high frequency module in a twelfth preferred embodiment according to the present invention, wherein FIG. 15A is a plan view, FIG. 15B is a bottom view, and FIG. 15C is a cross sectional view of FIG. 15A cut along A15-A'15 line;

DETAILED DESCRIPTION OF THE PREFERRED EMBODIMENTS

Next, an embodiment of the present invention will be explained.

Firstly, topological expressions of transmission lines of an antenna according to the present invention will be explained referring to FIGS. 1 to 3.

The electrical configuration of an antenna can be described by using leakage loss transmission lines. The leakage loss transmission line may be expressed by a following formula (1).

$$Z_c \tan(\beta L - j\alpha L^n) \tag{1}$$

wherein $Z_c$ is a characteristic impedance, $\beta$ is a propagation coefficient, $\alpha$ is a loss coefficient, n is a nonlinear leakage multiplier, and L is a line length.

In JP-A-1-158805, a technique of equivalently compacting the line length L by multiplying the propagation coefficient by $\sqrt{\epsilon r}$ by using a dielectric material having a specific dielectric constant $\epsilon r$.

Figure 1:
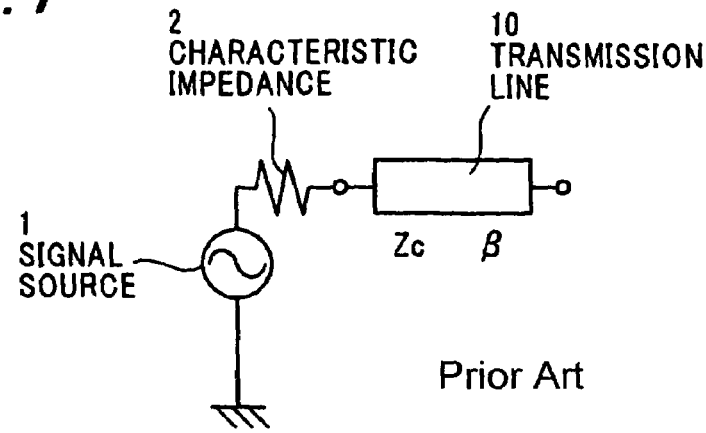
FIG. 1 is a diagram showing topological expressions of transmission lines of a conventional antenna.

This situation is explained with referring to FIG. 1.

According to a topology shown in FIG. 1, a transmission line 10 expressing an antenna is connected to a high frequency circuit expressed by a signal source 1 and a characteristic impedance 2.

Impedance matching between the high frequency circuit and the antenna is kept in a good condition, since a reactance component is offset at a coupling point of the high frequency circuit and the antenna. Since a susceptance of the high frequency circuit side is zero and the transmission line 10 is an open stub, when an equation $\beta L=\pi/2$ is established, the susceptance of the antenna side becomes zero, so that a good matching condition can be realized.

However, when the dielectric material is not used, an equation $\beta=2\pi/\lambda$ ($\lambda$ is wavelength) is established, therefore $L=\lambda/4$ is established. For instance, when the frequency is 400 MHz, the transmission line length L becomes 5 cm. Therefore, it becomes very difficult to realize such a length in a high frequency circuit of a conventional mobile radio terminal. In the prior art, the line length L is set as $1/\sqrt{\epsilon r}$ by using a bulk dielectric material.

Figure 2:
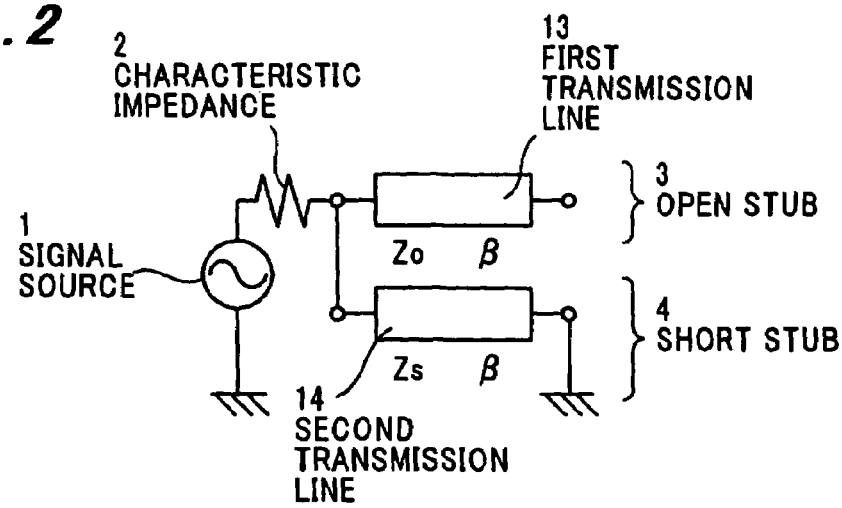
FIG. 2 is a diagram showing topological expressions of transmission lines of an antenna according to the present invention.

According to the present invention, a topology shown in FIG. 2 is employed.

According to the topology shown in FIG. 2, a first transmission line 13 and a second transmission line 14 expressing an antenna are connected in parallel with a high frequency circuit expressed by a characteristic impedance 2 and a signal source 1. The first transmission line 13 constitutes an open stub 3, and its characteristic impedance is Zo. The second transmission line 14 constitutes a short stub 4, and its characteristic impedance is Zs. The susceptance of the antenna side at a coupling point between the high frequency circuit and the antenna is expressed as a following formula (2).

$$\frac{1 - \frac{Zs}{Zo}\tan\beta L_1 \tan\beta L_2}{jZs\tan\beta L_2} \tag{2}$$

wherein, $\beta$ is a propagation coefficient, $L_1$ is a line length of the first transmission line 13, and $L_2$ is a line length of the second transmission line 14.

In the formula (2), assuming Zs=Zo, a solution of the formula (2) becomes 0, when an equation $L_1+L_2=\lambda/4$ is established. Therefore, the effect of miniaturizing the antenna cannot be obtained in a situation identical to the situation shown in FIG. 1. However, assuming Zs>Zo, a condition that the solution of the formula (2) becomes 0 is expressed as $L_1+L_2<\lambda/4$ s, therefore a dimension of the antenna can be reduced.

Figure 3:
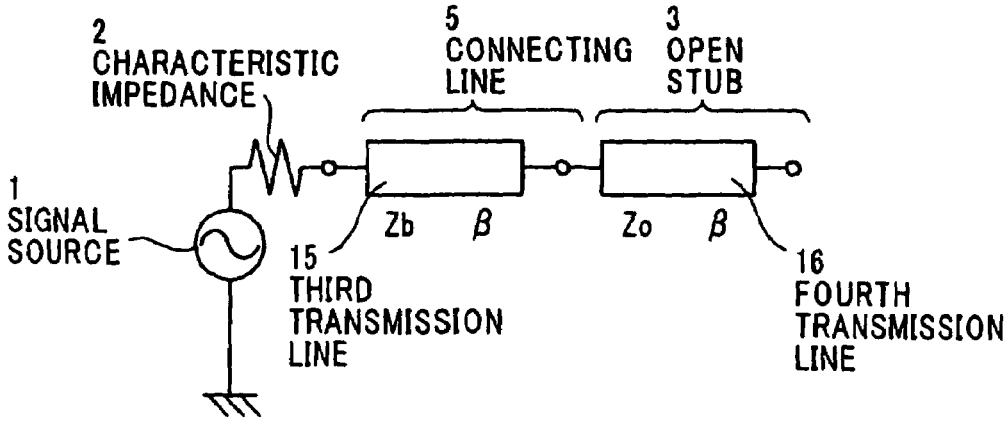
FIG. 3 is a diagram showing topological expressions of transmission lines of an antenna according to the present invention.

Although a parallel topology is shown in FIG. 2, similar results will be obtained in a serial topology shown in FIG. 3.

In FIG. 3, a third transmission line 15 and a fourth Transmission line 16 expressing an antenna is connected in series with a high frequency circuit expressed by a characteristic impedance 2 and a signal source 1.

The third transmission line 15 constitutes a connecting line 5, and its characteristic impedance is Zb. The fourth transmission line 16 constitutes an open stub 3, and its characteristic impedance is Zo. Reactance of the antenna side at a coupling point between the high frequency circuit and antenna is expressed by a following formula (3).

$$jZb\frac{1 - \frac{Zb}{Zo}\tan\beta L_1 \tan\beta L_2}{\frac{Zb}{Zo}\tan\beta L_2 + \tan\beta L_1} \tag{3}$$

wherein $\beta$ is a propagation coefficient, $L_1$ is a line length of the third transmission line 15, and $L_2$ is a line length of the fourth transmission line 16.

Since a reactance of the high frequency circuit side is 0, a condition that a solution of the formula (3) becomes 0 is similar to the condition that a solution of the formula (2) becomes 0.

Therefore, in an antenna the electric configuration of which is expressed by a topology comprising at least one opening stub 3, one or more connecting line 5 or short stub 4, the dimensions of the antenna can be reduced without using the bulk dielectric material, by lowering the characteristic impedance Zo of the opening stub 3 than the characteristic impedance Zb of the connecting line 5 and characteristic impedance Zs of the short stub Zs.

In other words, it is possible to reduce the dimensions of the antenna by changing the characteristic impedances instead of changing the propagation coefficient of transmission lines in the topology.

When a capacitance of a strip conductor and a grounding conductive plate, which determines a characteristic impedance Zc of a transmission line, is defined as a capacitance C, the characteristic impedance Zc is inversely proportional to $\sqrt{C}$. Therefore, the short stub 4 having low characteristic impedance Zs can be realized by increasing the capacitance C by reducing a relative position of the strip conductor and the grounding conductive plate. Accordingly, it is extremely suitable for sliming the antenna configuration.

According to the present invention, the reduction of the antenna dimensions can be realized in a thin configuration. In addition, when an antenna is expressed by a topology using transmission lines, a characteristic impedance of a short stub or connecting line is large. Therefore, a capacitance coupling with a grounding conductive plate constituting the antenna is small. As a result, a radiant efficiency of the electric wave of the antenna can be kept large.

In a conventional method for reducing the antenna dimension by using a bulk dielectric material, a capacitance with grounding conductive plates for all transmission lines constituting the antenna is increased. As a result, the radiant efficiency of the antenna is decreased. According to the present invention, the improvement of the antenna efficiency can be achieved as well as the miniaturization and sliming of antenna simultaneously.

Next, preferred embodiments according to the present invention will be explained in more detail.

Figure 4A:
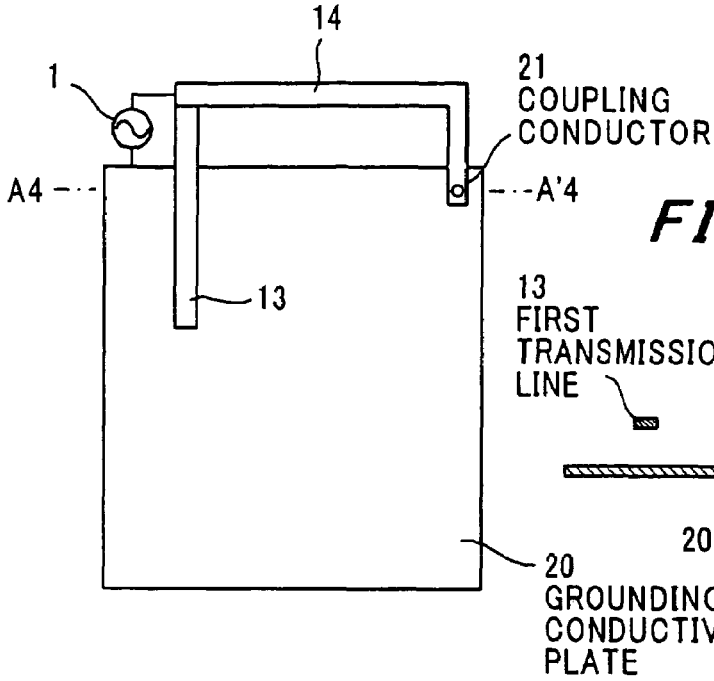
Figure 4B:
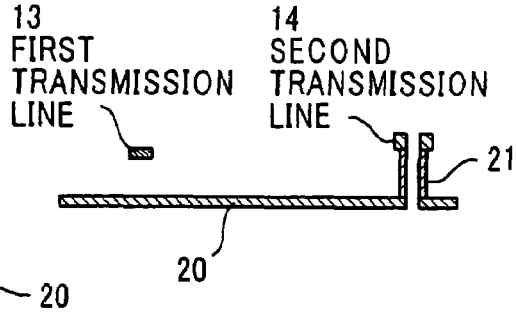

FIGS. 4A and 4B show a small size thin type antenna in a first preferred embodiment according to the invention, wherein FIG. 4A is a plan view, and FIG. 4B is a cross sectional view of FIG. 4A cut along A4-A4' line.

As shown in FIGS. 4A and 4B, a first transmission line 13, which is an open stub, is positioned facing to a grounding conductive plate 20 planarly. On the other hand, a second transmission line 14, which is a short stub, is positioned not to face the grounding conductive plate 20 planarly, in other words, above the grounding conductive plate 20 in a circumference direction. This open stub is realized by a microstrip line, and the short stub comprises a strip conductor.

The first transmission line 13 and one end of the second transmission line 14 are coupled with a drive potential of a signal source 1, and a ground potential of the signal source 1 is coupled-with a grounding conductive plate 20.

Another end of the second transmission line 14 is coupled with the grounding conductive plate 20 via a coupling conductor 21.

According to the first preferred embodiment, a capacitance of the first transmission line 13 to the grounding conductive plate 20 is sufficiently larger than the capacitance of the second transmission line 14 to the grounding conductive plate 20. Therefore, as explained in the topology expression of FIG. 2, when a sum of the length of the first transmission line 13 and the second transmission line 14 is a value smaller than a ¼ wavelength of the electric wave to be received or transmitted by the antenna, a good impedance matching at the signal source 1 can be realized.

In the first preferred embodiment, the first transmission line 13 and second transmission line 14 are realized in a coplanar structure and the first transmission line 13 and second transmission line 14 as well as the grounding conductive plate 20 can be realized in a thin configuration. Therefore, there is an effect in that an antenna having a good gain for the electric wave with a long wavelength and low frequency and having a small size and thin configuration can be realized.

A second preferred embodiment according to the present invention will be explained referring to FIGS. 5A and 5B.

Figure 5A:
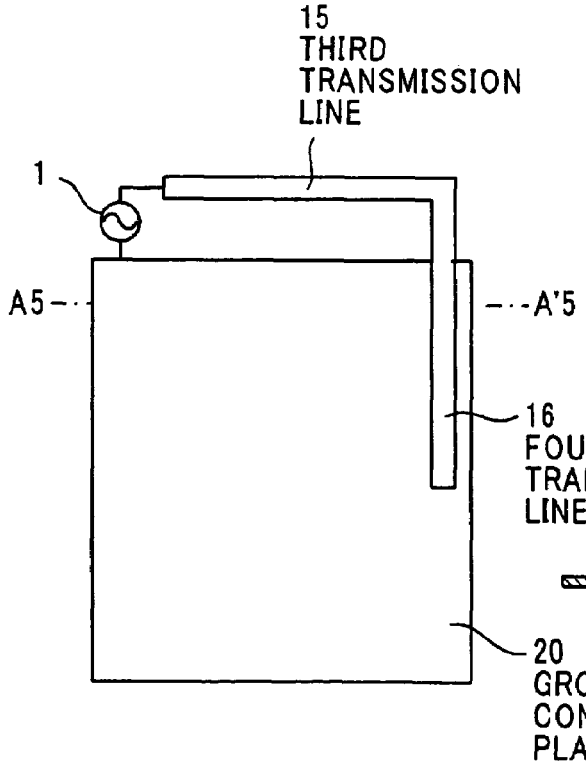
Figure 5B:
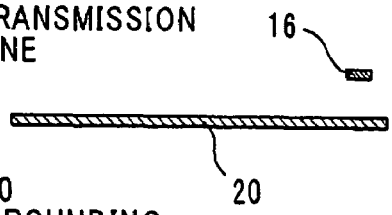

FIGS. 5A and 5B show a small size thin type antenna in the second preferred embodiment according to the present invention, wherein FIG. 5A is a plan view, and FIG. 5B is a cross sectional view of FIG. 5A cut along A5-A'5 line.

The second preferred embodiment is different from the first preferred embodiment of FIGS. 4A and 4B in the following point. Namely, instead of the first transmission line 13, second transmission line 14 and coupling conductor 21, a third transmission line 15, which is a connecting line, is positioned not to face the grounding conductive plate 20 planarly at a drive potential of a signal source 1, in other words, above the grounding conductive plate 20 in a circumference direction. On the other hand, a fourth transmission line 16, which is an open stub, is positioned facing to a grounding conductive plate 20 planarly.

According to the second preferred embodiment, a capacitance of the fourth transmission line 16 to the grounding conductive plate 20 is sufficiently larger than the capacitance of the third transmission line 15 to the grounding conductive plate 20. Therefore, as explained in the topology expression of FIG. 3, when a sum of the length of the fourth transmission line 16 and the third transmission line 15 is a value smaller than a ¼ wavelength of the electric wave to be received or transmitted by the antenna, a good impedance matching at the signal source 1 can be realized.

Comparing with the first preferred embodiment shown in FIGS. 4A and 4B, a coupling conductor 21 is not necessary. Therefore, there is an effect in that the fabrication step can be reduced.

A third preferred embodiment according to the present invention will be explained referring to FIGS. 6A and 6B.

Figure 6A:
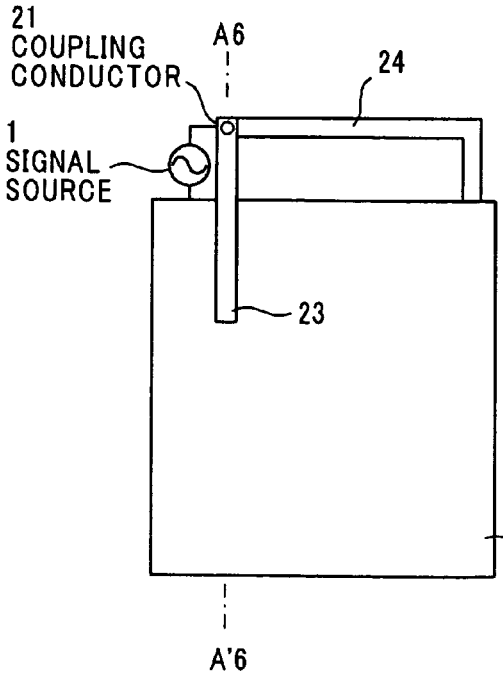
Figure 6B:
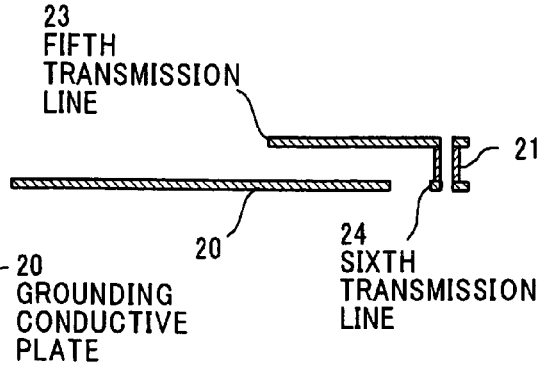

FIGS. 6A and 6B show a small size thin type antenna in the third preferred embodiment according to the invention, wherein FIG. 6A is a plan view, and FIG. 6B is a cross sectional view of FIG. 6A cut along A6-A6' line.

As shown in FIGS. 6A and 6B, a fifth transmission line 23, which is an open stub, is positioned facing to a grounding conductive plate 20. On the other hand, a sixth transmission line 24, which is a short stub, is positioned not to face the grounding conductive plate 20 planarly, in other words, in a circumference direction of the grounding conductive plate 20.

The fifth transmission line 23 is coupled via a coupling conductor 21, and one end of the sixth transmission line 24 is directly coupled with a drive-potential of a signal source 1 simultaneously, and a ground potential of the signal source 1 is coupled with the grounding conductive plate 20.

Another end of the sixth transmission line 24 is directly coupled with the grounding conductive plate 20.

According to the third preferred embodiment, a capacitance of the fifth transmission line 23 to the grounding conductive plate 20 is sufficiently larger than the capacitance of the fourth transmission line 24 to the grounding conductive plate 20. Therefore, as explained in the topology expression of FIG. 2, when a sum of the length of the fifth transmission line 23 and the sixth transmission line 24 is a value smaller than a ¼ wavelength of the electric wave to be received or transmitted by the antenna, a good impedance matching at the signal source 1 can be realized.

In the third preferred embodiment, the sixth transmission line 24 and grounding conductive plate 20 are realized in a coplanar structure and the antenna can be realized in thin configuration similarly to the first preferred embodiment shown in FIGS. 4A and 4B. Therefore, there is an effect in that an antenna having a good gain for the electric wave with a long wavelength and low frequency and having a small size and thin configuration can be realized.

A fourth preferred embodiment according to the present invention will be explained referring to FIGS. 7A and 7B.

Figure 7A:
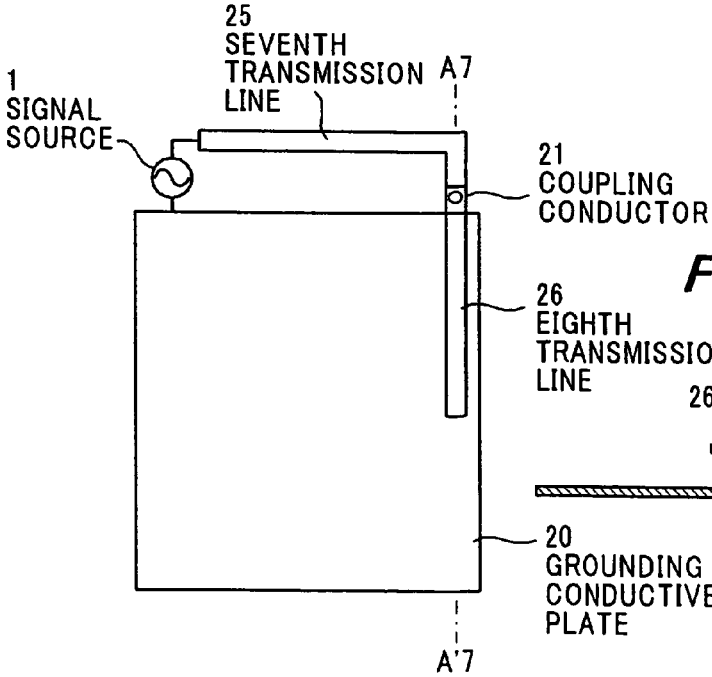
Figure 7B:
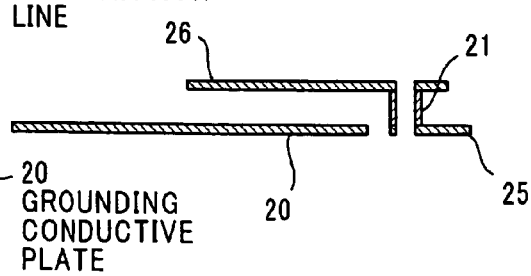

FIGS. 7A and 7B show a small size thin type antenna in the fourth preferred embodiment according to the present invention, wherein FIG. 7A is a plan view, and FIG. 7B is a cross sectional view of FIG. 7A cut along A7-A'7 line.

The fourth preferred embodiment is different from the third preferred embodiment of FIGS. 6A and 6B in the following point. Namely, instead of the fifth transmission line 23, sixth transmission line 24 and coupling conductor 21, a seventh transmission line 25, which is a connecting line, is positioned not to face the grounding conductive plate 20 planarly at a drive potential of a signal source 1, in other words, in a circumference direction of the grounding conductive plate 20. On the other hand, an eighth transmission line 26, which is an open stub, is positioned facing to the grounding conductive plate 20 planarly. Another end which is not coupled to the signal source 1 of the seventh transmission line 25 and one end of the eighth transmission line 26 are electrically coupled via a coupling conductor 21.

According to the fourth preferred embodiment, a capacitance of the eighth transmission line 26 to the grounding conductive plate 20 is sufficiently larger than the capacitance of the seventh transmission line 25 to the grounding conductive plate 20. Therefore, as explained in the topology expression of FIG. 3, when a sum of the length of the eighth transmission line 26 and the seventh transmission line 25 is a value smaller than a ¼ wavelength of the electric wave to be received or transmitted by the antenna, a good impedance matching at the signal source 1 can be realized similarly to the third preferred embodiment shown in FIGS. 6A and 6B.

A fifth preferred embodiment according to the present invention will be explained referring to FIGS. 8A to 8C.

Figures 8A, 8B, 8C:
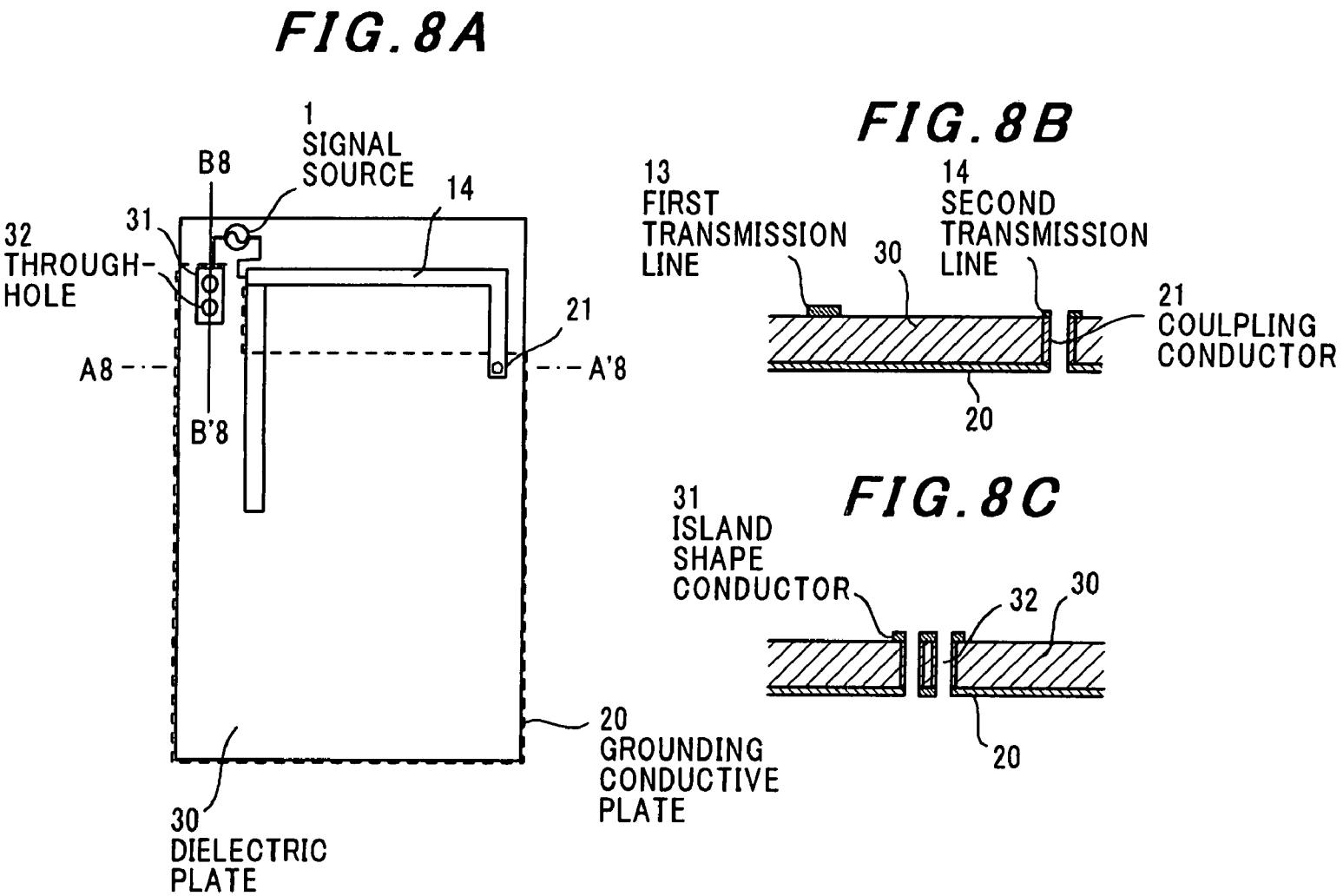

FIGS. 8A to 8C show a small size thin type antenna in the fifth preferred embodiment according to the present invention, wherein FIG. 8A is a plan view, FIG. 8B is a cross sectional view of FIG. 8A cut along A8-A'8 line, and FIG. 8C is a cross sectional view of FIG. 8A cut along B8-B'8 line.

The fifth preferred embodiment is different from the first preferred embodiment of FIGS. 4A and 4B in the following point. The grounding conductive plate 20, and the first transmission line 13 and second transmission line 14 formed coplanarly are respectively formed on both sides of a dielectric plate 30. An island shape conductor 31 is formed coplanarly with the first transmission line 13. The island shape conductor 31 and the grounding conductive plate 20 are electrically coupled with each other via a through hole 32 formed in the dielectric plate 30. One end of the first transmission line 13 and one end of the second transmission line 14 are simultaneously coupled with a drive potential of the signal source 1, and a ground potential of the signal source 1 is coupled with the island shape conductor 31.

According to the fifth preferred embodiment, while maintaining the effect obtained by the first preferred embodiment shown in FIGS. 4A and 4B, a relationship of a physical position between the first transmission line 13, the second transmission line 14 and the grounding conductive plate 20 can be easily maintained. Therefore, it is possible to maintain the performance in the antenna fabrication and to improve the yield in mass production. Further, by forming the dielectric plate 30 in a thin configuration, the device configuration itself becomes bendable easily compared with the first preferred embodiment shown in FIGS. 4A and 4B. Therefore, there is an effect in that freedom of design for mounting the antenna on a radio device can be improved remarkably.

A sixth preferred embodiment according to the present invention will be explained referring to FIGS. 9A to 9C.

Figures 9A, 9B, 9C:
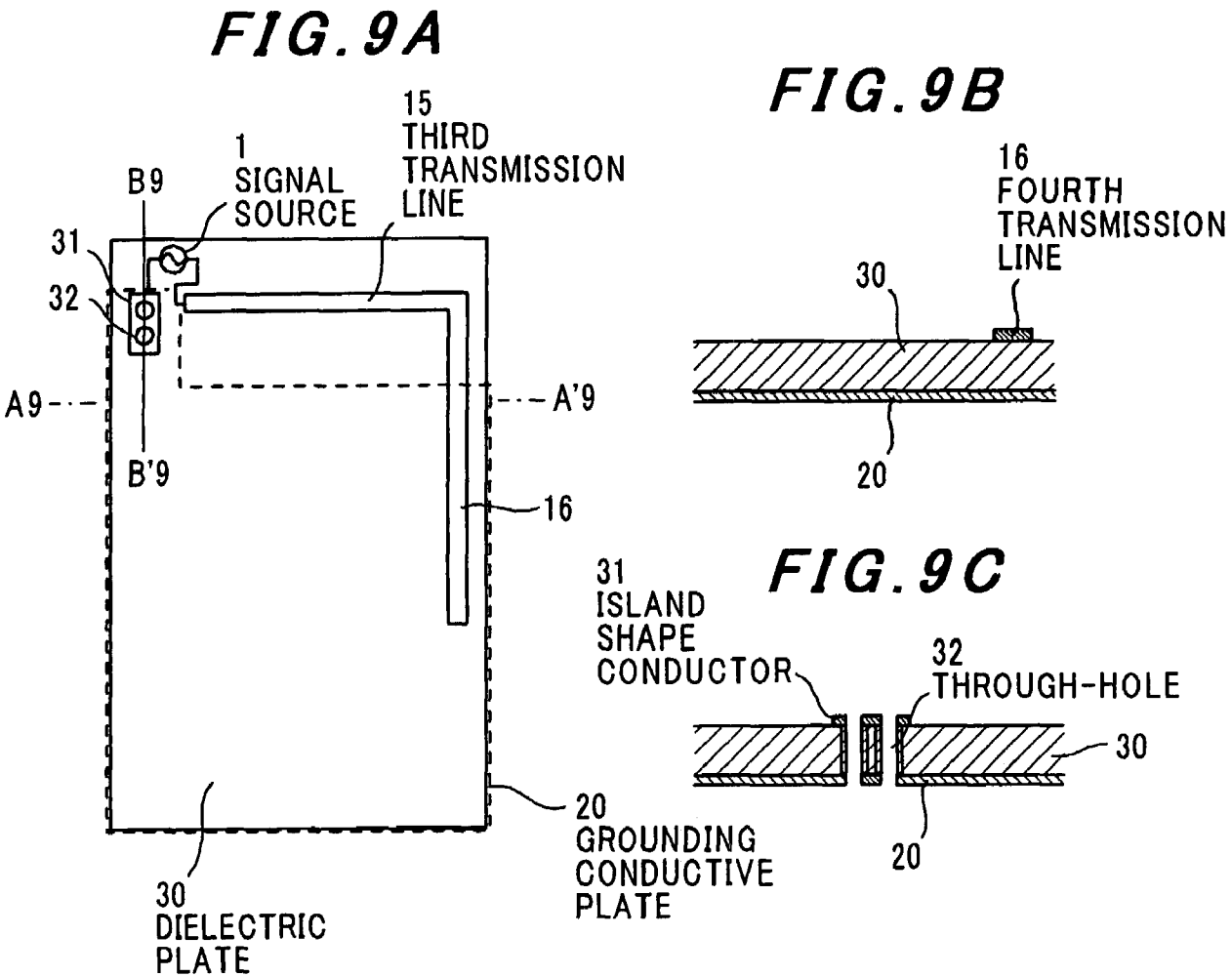

FIGS. 9A to 9C show a small size thin type antenna in the sixth preferred embodiment according to the present invention, wherein FIG. 9A is a plan view, FIG. 9B is a cross sectional view of FIG. 9A cut along A9-A' 9 line, and FIG. 9C is a cross sectional view of FIG. 9A cut along B9-B'9 line.

The sixth preferred embodiment is different from the second preferred embodiment of FIGS. 5A and 5B in the following point. The grounding conductive plate 20, and the third transmission line 15 and fourth transmission line 16 formed coplanarly are respectively formed on both sides of a dielectric plate 30. An island shape conductor 31 is formed coplanarly with the third transmission line 15. The island shape conductor 31 and the grounding conductive plate 20 are electrically coupled with each other via a through hole 32 formed in the dielectric plate 30. One end of the fourth transmission line 16 is coupled with a drive potential of the signal source 1, and a ground potential of the signal source 1 is coupled with the island shape conductor 31.

According to the sixth preferred embodiment, while maintaining the effect obtained by the second preferred embodiment shown in FIGS. 5A and 5B, a relationship of a physical position between the third transmission line 15, the fourth transmission line 16 and the grounding conductive plate 20 can be easily maintained. Therefore, it is possible to maintain the performance in the antenna fabrication and to improve the yield in mass production. Further, by forming the dielectric plate 30 in a thin configuration, the device configuration itself becomes bendable easily compared with the second preferred embodiment shown in FIGS. 5A and 5B. Therefore, there is an effect in that freedom of design for mounting the antenna on a radio device can be improved remarkably.

A seventh preferred embodiment according to the present invention will be explained referring to FIGS. 10A and 10B.

Figure 10A:
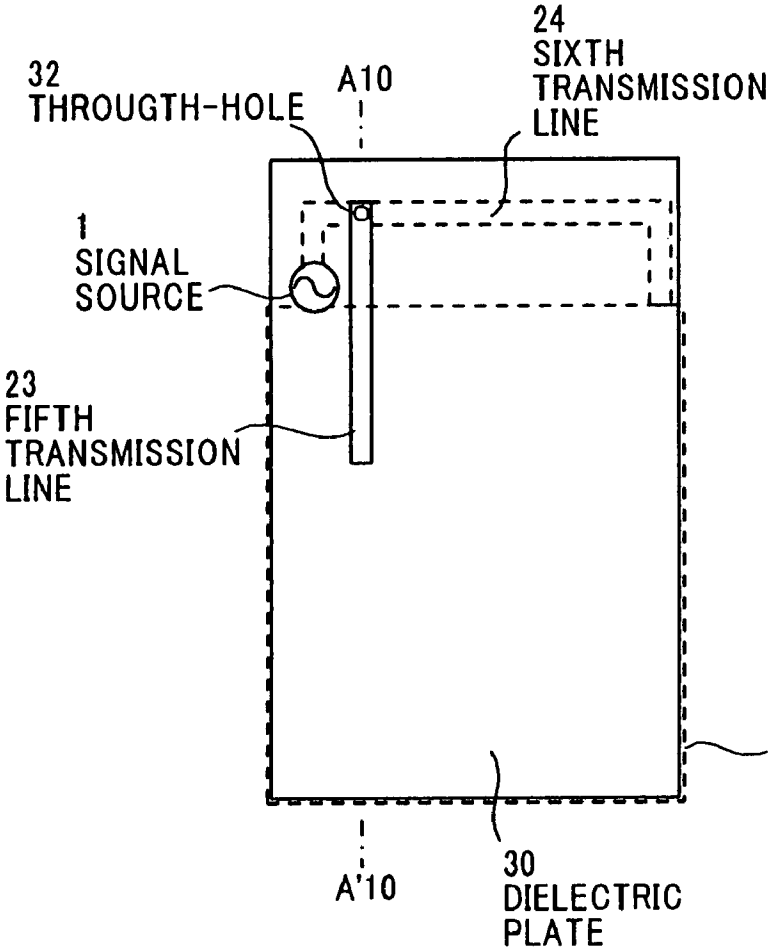
Figure 10B:
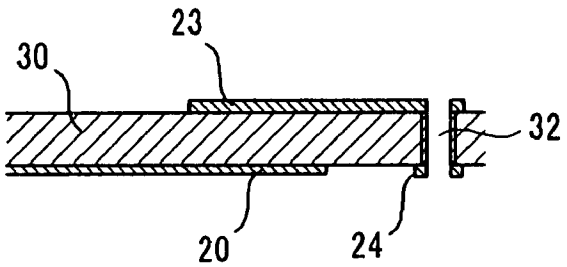

FIGS. 10A and 10B show a small size thin type antenna in the seventh preferred embodiment according to the present invention, wherein FIG. 10A is a plan view, and FIG. 10B is a cross sectional view of FIG. 10A cut along A10-A'10 line.

The seventh preferred embodiment is different from the third preferred embodiment of FIGS. 6A and 6B in the following point. The fifth transmission line 23, and the grounding conductive plate 20 and sixth transmission line 24 formed coplanarly are respectively formed on both sides of a dielectric plate 30. The fifth transmission line 23 and sixth transmission line 24 are electrically coupled with each other via a through hole 32 formed in the dielectric plate 30.

According to the seventh preferred embodiment, while maintaining the effect obtained by the third preferred embodiment shown in FIGS. 6A and 6B, a relationship of a physical position between the fifth transmission line 23, the grounding conductive plate 20 and the sixth transmission line 24 can be easily maintained. Therefore, it is possible to maintain the performance in the antenna fabrication and to improve the yield in mass production. Further, by forming the dielectric plate 30 in a thin configuration, the device configuration itself becomes bendable easily compared with the third preferred embodiment shown in FIGS. 6A and 6B. Therefore, there is an effect in that freedom of design for mounting the antenna on a radio device can be improved remarkably.

An eighth preferred embodiment according to the present invention will be explained referring to FIGS. 11A and 11B.

Figure 11A:
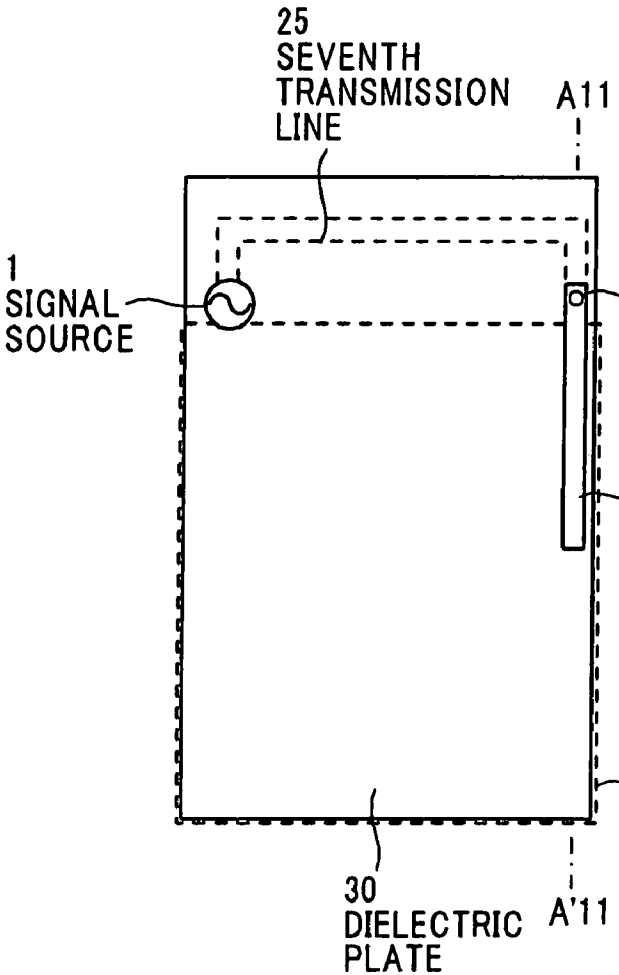
Figure 11B:
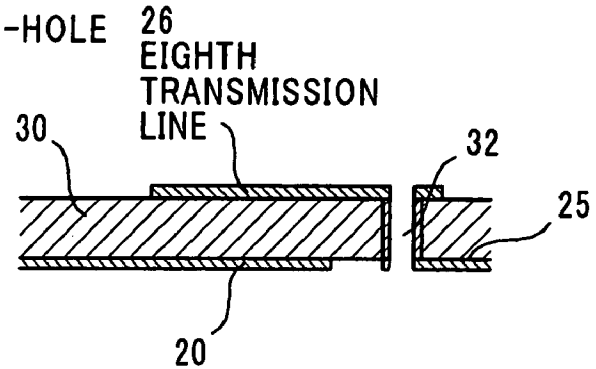

FIGS. 11A and 11B show a small size thin type antenna in the eighth preferred embodiment according to the present invention, wherein FIG. 11A is a plan view, and FIG. 11B is a cross sectional view of FIG. 11A cut along A11-A'11 line.

The eighth preferred embodiment is different from the fourth preferred embodiment of FIGS. 7A and 7B in the following point. The eighth transmission line 26, and the grounding conductive plate 20 and seventh transmission line 25 formed coplanarly are respectively formed on both sides of the dielectric plate 30. The eighth transmission line 26 and seventh transmission line 25 are electrically coupled with each other via a through hole 32 formed in the dielectric plate 30.

According to the eighth preferred embodiment, while maintaining the effect obtained by the fourth preferred embodiment shown in FIGS. 7A and 7B, a relationship of a physical position between the seventh transmission line 25, the grounding conductive plate 20 and the eighth transmission line 26 can be easily maintained. Therefore, it is possible to maintain the performance in the antenna fabrication and to improve the yield in mass production. Further, by forming the dielectric plate 30 in a thin configuration, the device configuration itself becomes bendable easily compared with the fourth preferred embodiment shown in FIGS. 7A and 7B. Therefore, there is an effect in that freedom of design for mounting the antenna on a radio device can be improved remarkably.

A ninth preferred embodiment of the present invention will be explained referring to FIGS. 12A and 12B.

Figures 12A, 12B:
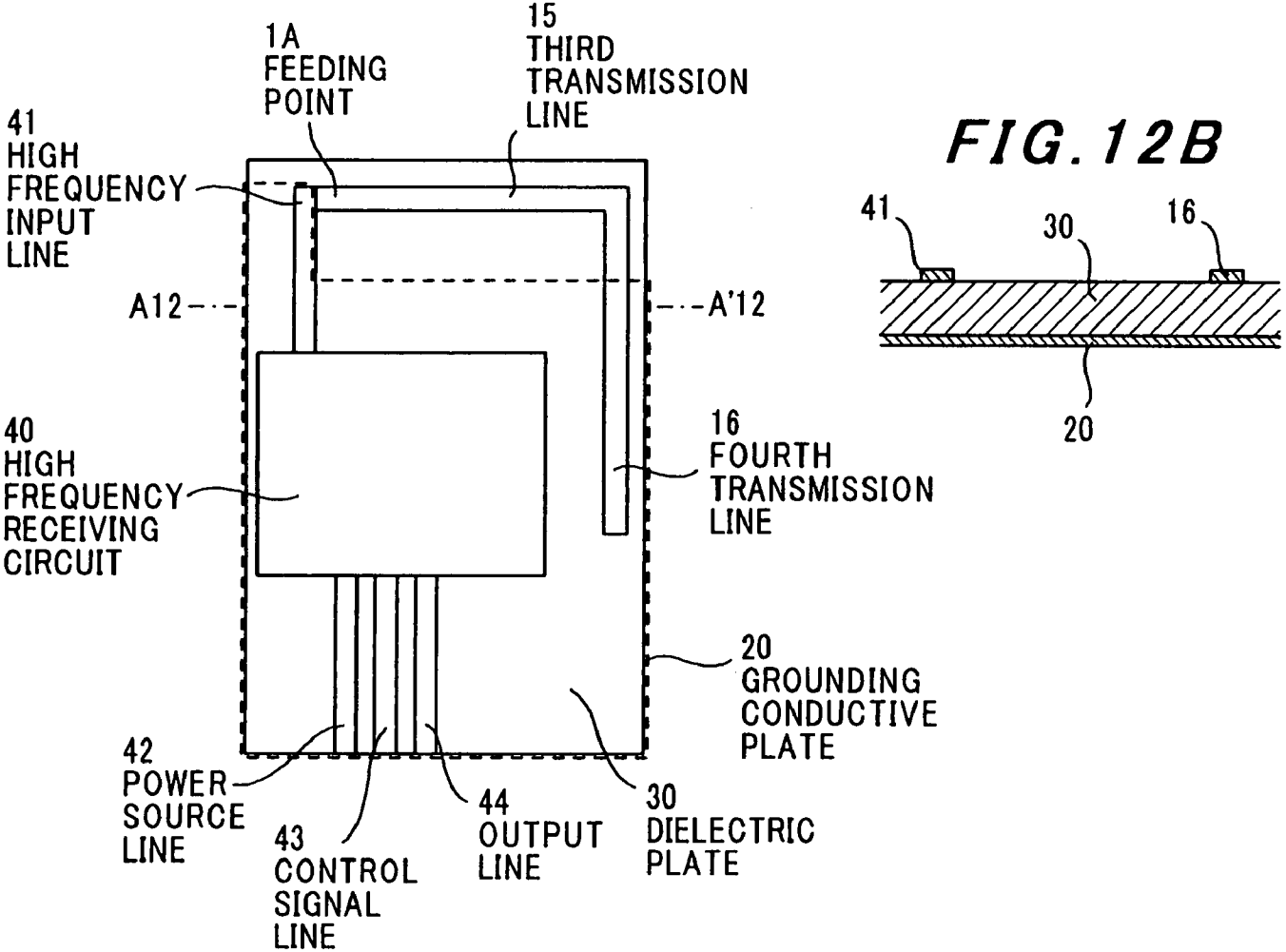

FIGS. 12A and 12B show a high frequency module in the ninth preferred embodiment according to the present invention, wherein FIG. 12A is a plan view, and FIG. 12B is a cross sectional view of FIG. 12A cut along A12-A'12 line.

In the ninth preferred embodiment, following points are added to a small size thin type antenna structure in the sixth preferred embodiment shown in FIGS. 9A to 9C. A high frequency receiving circuit 40, which uses a grounding conductive plate 20 as a common ground potential plate, is formed on a plane of a dielectric plate 30 facing to the grounding conductive plate 20. Further, a high frequency input line 41 of the high frequency receiving circuit 40 is formed on the same plane, and is coupled with a feeding point 1A of an antenna, and a power source line 42, a control signal line 43 and an output line 44 of the high frequency receiving circuit 40 are formed.

In this high frequency module, an input signal voltage generated at the signal source 1 of the antenna is input to the high frequency receiving circuit 40 through the high frequency input line 41. Processing such as amplification, frequency determination and waveform shaping by using a filter, frequency down conversion, etc. are conducted for an input signal voltage to be converted into a intermediate frequency or baseband frequency, and the signal is supplied to outside of the high frequency module through the output line 44. A power source and a control signal of the high frequency receiving circuit 40 are respectively supplied from the outside of the high frequency module through the power source line 42 and control signal line 43.

According to the ninth preferred embodiment, since a thin high frequency receiving module integrating an antenna can be realized, a volume of the high frequency receiving module itself can be reduced, a freedom of design for mounting the high frequency module on a radio device can be improved, and an occupying volume of the high frequency receiving module within the radio device can be reduced. As a result, it is effective for miniaturization and sliming of the radio device.

A tenth preferred embodiment of the present invention will be explained referring to FIGS. 13A and 13B.

Figures 13A, 13B:
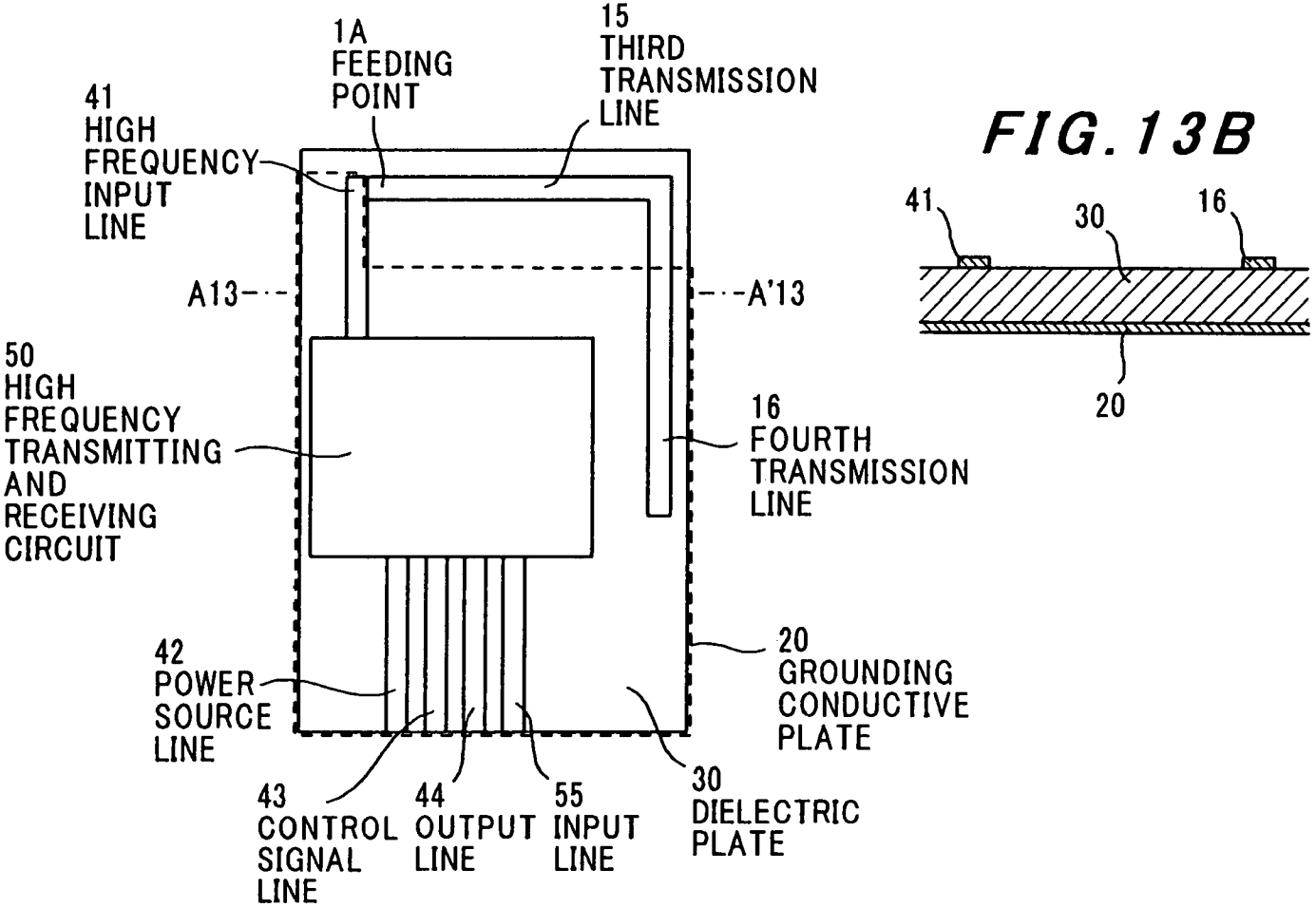

FIGS. 13A and 13B show a high frequency module in the tenth preferred embodiment according to the present invention, wherein FIG. 13A is a plan view, and FIG. 13B is a cross sectional view of FIG. 13A cut along A13-A'13 line.

The tenth preferred embodiment is different from the ninth preferred embodiment shown in FIGS. 12A and 12B in following points. A high frequency transmitting and receiving circuit 50 is provided instead of the high frequency receiving circuit 40. Further, an input line 55 connected to the high frequency transmitting and receiving circuit 50 is formed on a plane of the dielectric plate 30 facing to the grounding conductive plate 20.

In this high frequency module, a transmitting and receiving signal voltage generated at the signal source 1 of the antenna is input to the high frequency transmitting and receiving circuit 50 through the high frequency input line 41. Processing such as amplification, frequency determination and waveform shaping by using a filter, frequency down conversion, etc. are conducted for the transmitting and receiving signal voltage to be converted into a intermediate frequency or baseband frequency, and the signal is transmitted to or received from the outside of the module through the output line 44 or the input line 55. A power source and a control signal of the high frequency transmitting and receiving circuit 50 are respectively supplied from the outside of the module through the power source line 42 and control signal line 43.

According to the tenth preferred embodiment, since a thin type high frequency transmitting and receiving module integrating an antenna can be realized, a volume of the high frequency transmitting and receiving module itself can be reduced, a freedom of design for mounting the high frequency module on a radio device can be improved, and an occupying volume of the high frequency receiving module within the radio device can be reduced. As a result, it is effective for miniaturization and sliming of the radio device.

An eleventh preferred embodiment of the present invention will be explained referring to FIGS. 14A to 14C.

Figures 14A, 14B, 14C:
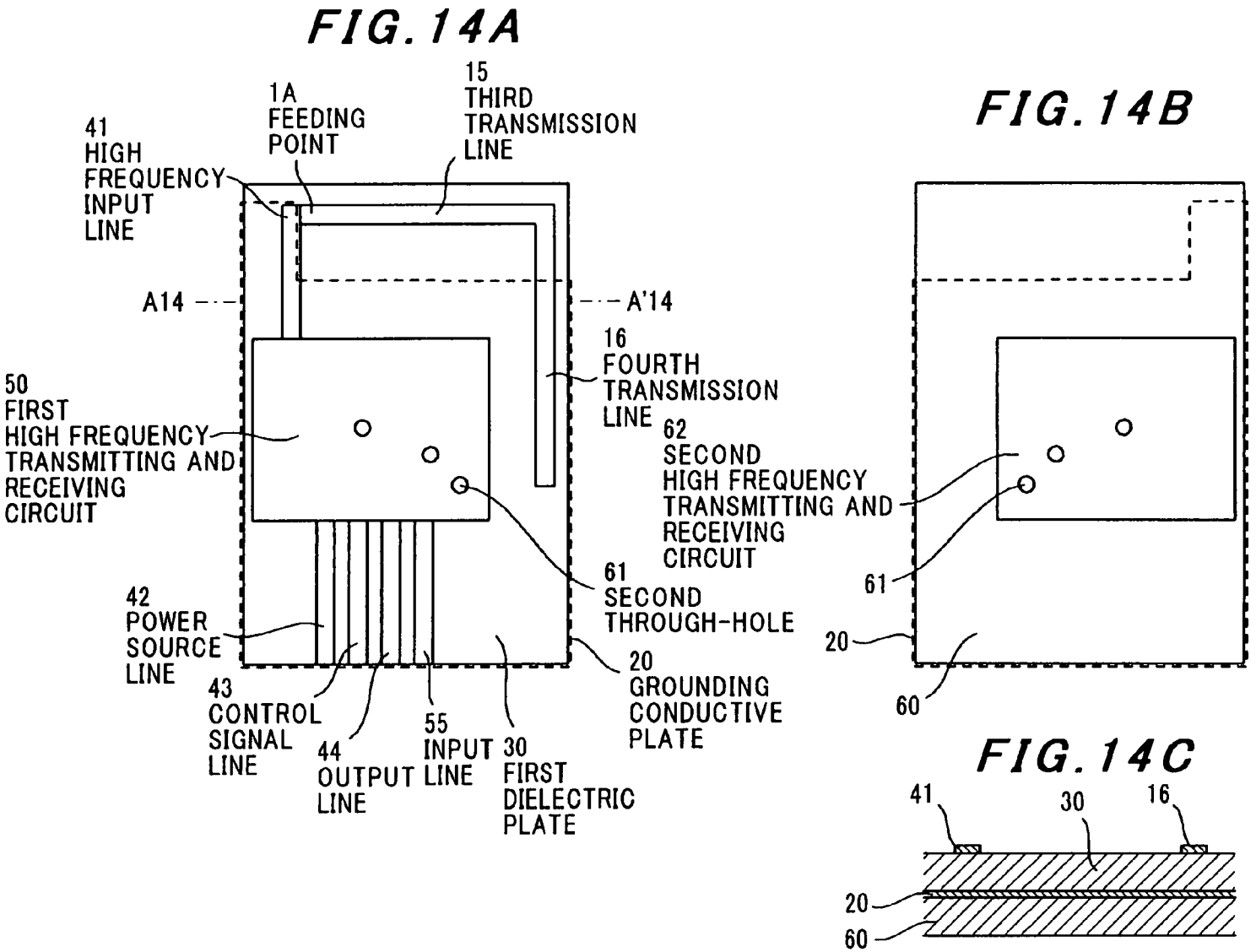

FIGS. 14A to 14C show a high frequency module in the eleventh preferred embodiment according to the present invention, wherein FIG. 14A is a plan view, FIG. 14B is a bottom view, and FIG. 14C is a cross sectional view of FIG. 14A cut along A14-A'14 line.

The eleventh preferred embodiment is different from the tenth preferred embodiment shown in FIGS. 13A and 13B in following points. A second dielectric plate 60 is formed on a plane of the grounding conductive plate 20 other than a plane on which a first dielectric plate 30 is formed. A second high frequency transmitting and receiving circuit 62 is formed on a plane of the second dielectric plate 60 facing to and other than a plane on which the grounding conductive plate 20 is formed. A power source and a control signal of the first high frequency transmitting and receiving circuit 50 and the second high frequency transmitting and receiving circuit 62 are respectively transmitted to and received from the outside of the module through a second through hole 61 formed on the dielectric plate 30 and the second dielectric plate 60.

According to the eleventh preferred embodiment, since a thin high frequency transmitting and receiving module can be formed on both sides of the high frequency module, a surface area of the thin module can be reduced. As a result, it is effective for miniaturization of the radio device, namely reduction of a total surface area of the radio device rather than sliming of the radio device.

A twelfth preferred embodiment of the present invention will be explained referring to FIGS. 15A to 15C.

FIGS. 15A to 15C show a high frequency module in the twelfth preferred embodiment according to the present invention, wherein FIG. 15A is a plan view, FIG. 15B is a bottom view, and FIG. 15C is a cross sectional view of FIG. 15A cut along A15-A'15 line.

The twelfth preferred embodiment is different from the eleventh preferred embodiment shown in FIGS. 14A to 14C in following points. A third dielectric plate 71 is formed between the grounding conductive plate 20 and the first dielectric plate 30, and a fourth dielectric plate 72 is formed between the grounding conductive plate 20 and the second dielectric plate 60. A first intermediate wiring plane 73 is formed on an interface plane between the first dielectric plate 30 and the third dielectric plate 71, and a second intermediate wiring plane 74 is formed on an interface plane between the second dielectric plate 60 and the fourth dielectric plate 72. A power source and a control signal of the first high frequency transmitting and receiving circuit 50 and a second high frequency transmitting and receiving circuit 62 are respectively transmitted to and received from the outside of the module through a second through hole 61 formed on the first dielectric plate 30 and the second dielectric plate 60, as well as through a wiring pattern formed on the first intermediate wiring plane 73 and a wiring pattern formed on the second intermediate wiring plane 74.

According to the twelfth preferred embodiment, compared with the eleventh preferred embodiment shown in FIGS. 14A to 14C, since a thin high frequency transmitting and receiving module can be formed within the module as well as on both sides of the module, a surface area of the thin module can be further reduced. As a result, it is effective for miniaturization of the radio device, namely reduction of a total surface area of the radio device rather than sliming of the radio device.

A thirteenth preferred embodiment of the present invention will be explained referring to FIG. 16.

Figure 16:
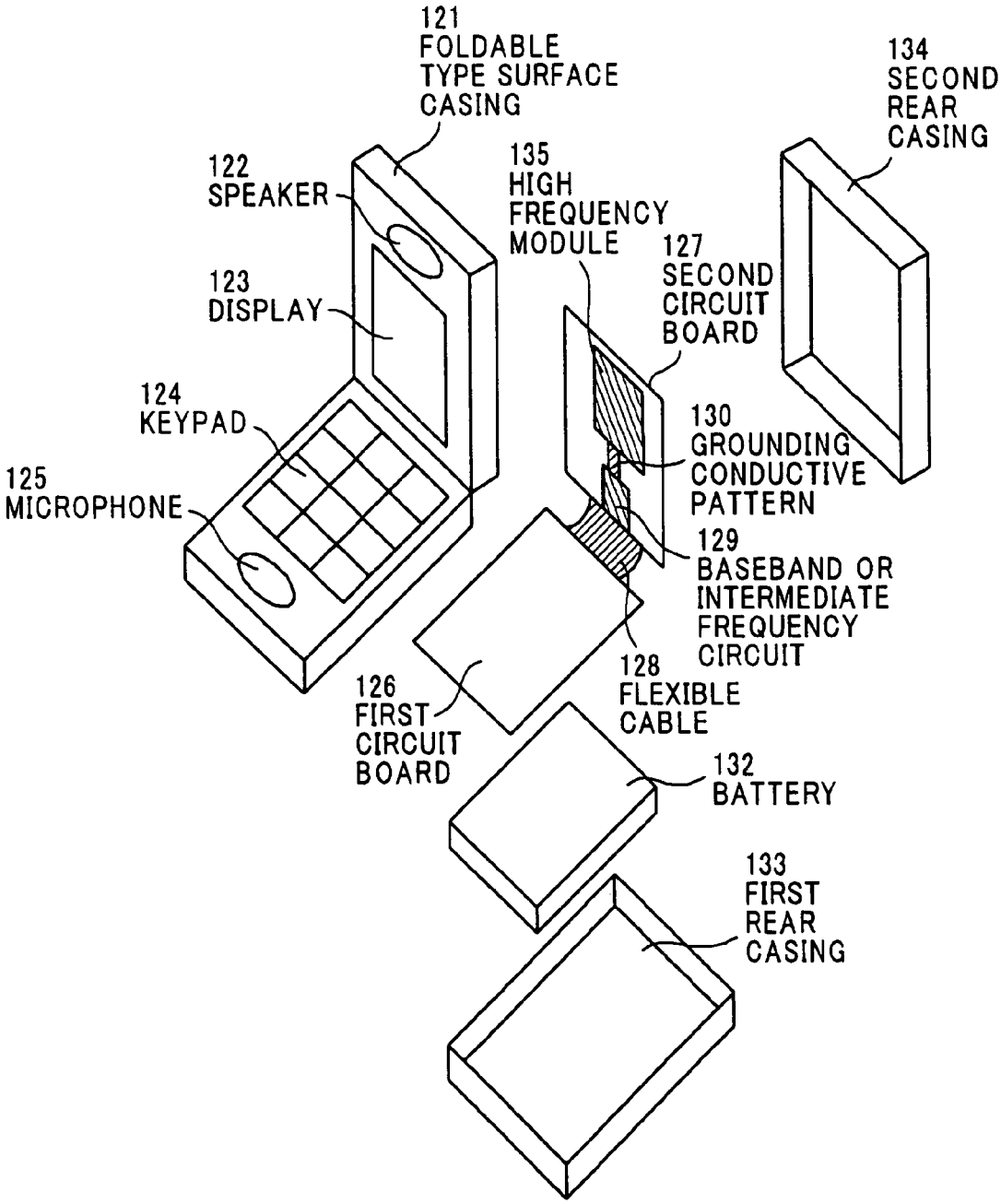
FIG. 16 is a disassembled perspective view of a communication device mounting a high frequency module in a thirteenth preferred embodiment according to the present invention.

FIG. 16 shows a disassembled perspective view of a communication device mounting a high frequency module in the thirteenth preferred embodiment according to the present invention.

A speaker 122, a display 123, a keypad 124, and a microphone 125 are mounted on a foldable type surface casing 121. A first circuit board 126 and a second circuit board 127 are connected by a flexible cable 128 accommodated within the foldable type casing 121. On the first circuit board 126 and/or second circuit board 127, a baseband or intermediate frequency circuit 129 and a high frequency module 135 according to the invention are mounted, and a grounding conductive pattern 130 coupling a signal of the high frequency module 135 and the baseband or intermediate frequency circuit 129, a control signal, and a power source is formed thereon. The first circuit board 126 and second circuit board 127 together with a battery 132 are accommodated in a first rear casing 133 and a second rear casing 134.

A characteristic feature of this structure is that the high frequency module 135 according to the present invention is sandwiched by the first circuit board 126 or the second circuit board 127 and the casing 121, and located on an opposite side of the display 123 or the microphone 125.

According to the thirteenth preferred embodiment, a radio terminal enjoying plural radio system services can be realized in a form of a built-in antenna. Therefore, it is effective in miniaturization of the radio terminal and improvement of user's convenience for storage and portability.

A fourteenth preferred embodiment of the present invention will be explained referring to FIG. 17.

Figure 17:
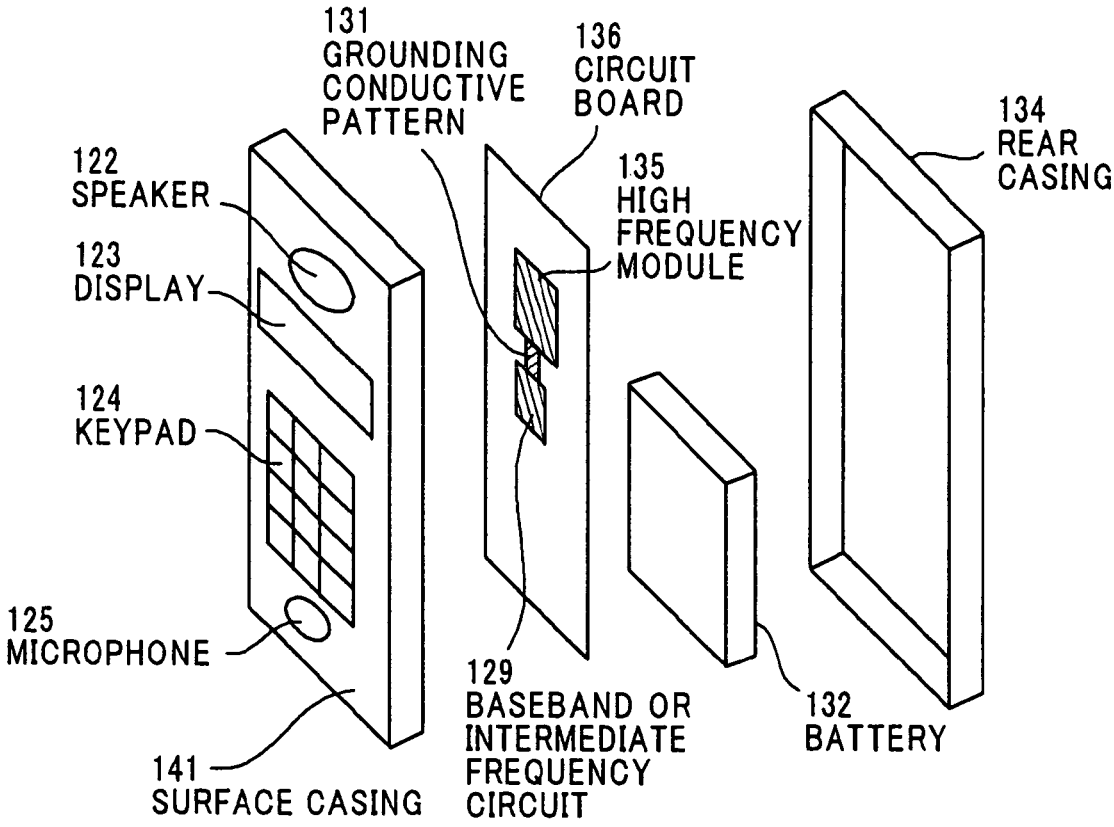
FIG. 17 is a disassembled perspective view of a communication device mounting a high frequency module in the fourteenth preferred embodiment according to the present invention.

FIG. 17 shows a disassembled perspective view of a communication device mounting a high frequency module in the fourteenth preferred embodiment according to the present invention.

A speaker 122, a display 123, a keypad 124, and a microphone 125 are mounted on a surface casing 141, and a circuit board 136 is accommodated within the surface casing 141. On the circuit board 136, a baseband or intermediate frequency circuit 129 and a high frequency module 135 according to the invention are mounted, and a grounding conductive pattern 131 coupling a signal of the high frequency module 135 and the baseband or intermediate frequency circuit 129, a control signal, and a power source is formed. The circuit board 136 together with a battery 132 is accommodated in a rear casing 134.

A characteristic feature of this structure is that the high frequency module 135 according to the present invention is 1 sandwiched between the circuit board 136 and the surface casing 141 and located on an opposite side of the display 123, the microphone 125, the speaker 122, or the keypad 124.

According to the thirteenth preferred embodiment, a radio terminal enjoying plural radio system services can be realized in a form of a built-in antenna. Therefore, it is effective in miniaturization of the radio terminal and improvement of user's convenience for storage and portability.

Compared with the thirteenth preferred embodiment shown in FIG. 16, since the circuit board and the casing can be fabricated integrally, it is effective for miniaturization of the terminal surface and reduction of manufacturing cost by reducing the number of assembling steps.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching herein set forth.

What is claimed is:

1. A small size thin type antenna, an electrical structure of which is expressed by a topology, comprising:

an open stub; and a connecting line or short stub, wherein a characteristic impedance of the open stub is lower than a characteristic impedance of at least one of the connecting line and the short stub.

2. The small size thin type antenna, according to claim 1, wherein the open stub comprises a microstrip line, and wherein a strip conductor constituting the connecting line or the short stub does not completely face to a grounding conductor planarly.

3. The small size thin type antenna, according to claim 2, wherein the strip conductor constituting the connecting line or the short stub comprises a coplanar line which is grounded to the grounding conductor at either one or both sides.

4. The small size thin type antenna, according to claim 2, wherein the open stub faces to the grounding conductor planarly.

5. The small size thin type antenna, according to claim 1, further comprising:

a grounding conductor comprising a first grounding conductive plate, wherein the open stub comprises a first strip conductor facing completely to the first grounding conductive plate planarly, and wherein the connecting line or the short stub comprises a second strip conductor which is positioned coplanar to the first grounding conductive plate.

6. The small size thin type antenna, according to claim 5, further comprising:

a second grounding conductive plate which surrounds the open stub coplanarly and is coupled electrically with the first grounding conductive plate.

7. The small size thin type antenna, according to claim 5, further comprising:

a second grounding conductive plate, wherein the first grounding conductive plate, the second grounding conductive plate, the first strip conductor constituting the open stub, and the second strip conductor constituting the connecting line or the short stub are formed on a surface of a dielectric layer.

8. The small size thin type antenna, according to claim 7, wherein:

the first grounding conductive plate and the second grounding conductive plate are coupled electrically with each other via a through hole formed at the dielectric layer.

9. The small size thin type antenna, according to claim 7, wherein:

the first grounding conductive plate and the second grounding conductive plate are coupled electrically with each other via a plated conductor formed at a peripheral part of the dielectric layer.

10. The small size thin type antenna, according to claim 1, further comprising:

a grounding conductor comprising a first grounding conductive plate, wherein the open stub comprises a first strip conductor facing completely to the first grounding conductive plate planarly, and wherein the connecting line or the short stub comprises a second strip conductor which is positioned coplanar to the first strip conductor and does not face to the first grounding conductive plate planarly.

11. The small size thin type antenna, according to claim 10, further comprising:

a second grounding conductive plate which surrounds the open stub coplanarly and is coupled electrically with the first grounding conductive plate.

12. The small size thin type antenna, according to claim 1, wherein a sum of a line length of the open stub and a line length of the short stub is less than $\lambda/4$, where $\lambda$ is a wavelength to be used.

13. A multi-layered substrate for a small size thin type antenna, comprising:

a dielectric layer;

a first grounding conductive plate mounted on a first surface of said dielectric layer; and a second grounding conductive plate, a first strip conductor constituting an open stub, and a second strip conductor constituting a connecting line or short stub mounted on a second surface of the dielectric layer.

14. A high frequency module, comprising:

a multi-layered substrate which comprises:

a dielectric layer;

a first grounding conductive plate mounted on a first surface of said dielectric layer; and a second grounding conductive plate, a first strip conductor constituting an open stub, and a second strip conductor constituting a connecting line or short stub mounted on a second surface of the dielectric layer.

15. A radio terminal, comprising:

a small size thin type antenna, an electrical structure of which is expressed by a topology, which comprises:

an open stub; and a connecting line or short stub, wherein a characteristic impedance of the open stub is lower than a characteristic impedance of at least one of the connecting line and the short stub.

16. A radio terminal, comprising:

a multi-layered substrate which comprises:

a dielectric layer;

a first grounding conductive plate mounted on a first surface of the dielectric layer; and a second grounding conductive plate, a first strip conductor constituting an open stub, and a second strip conductor constituting a connecting line or short stub mounted on a second surface of the dielectric layer.

17. A radio terminal, comprising:

a high frequency module which comprises a multi-layered substrate which comprises:

a dielectric layer;

a first grounding conductive plate mounted on a first surface of the dielectric layer; and a second grounding conductive plate, a first strip conductor constituting an open stub, and a second strip conductor constituting a connecting line or short stub mounted on a second surface of the dielectric layer.

18. A multi-layered substrate for a small size thin type antenna, comprising:

a dielectric layer; and a first grounding conductive plate, a second grounding conductive plate, a first strip conductor constituting an open stub, and a second strip conductor constituting a connecting line or short stub, mounted on a surface of the dielectric layer, wherein a characteristic impedance of the open stub is lower than a characteristic impedance of at least one of the connecting line and the short stub.

19. A high frequency module, comprising:

a multi-layered substrate which comprises:

a dielectric layer; and a first grounding conductive plate, a second grounding conductive plate, a first strip conductor constituting an open stub, and a second strip conductor constituting a connecting line or short stub, mounted on a surface of the dielectric layer, wherein a characteristic impedance of the open stub is lower than a characteristic impedance of at least one of the connecting line and the short stub.

20. A radio terminal, comprising:

a multi-layered substrate which comprises:

a dielectric layer; and a first grounding conductive plate, a second grounding conductive plate, a first strip conductor constituting an open stub, and a second strip conductor constituting a connecting line or short stub, mounted on a surface of the dielectric layer, wherein a characteristic impedance of the open stub is lower than a characteristic impedance of at least one of the connecting line and the short stub.

* * * * *